US006922149B1

(12) United States Patent
Ford

(10) Patent No.: US 6,922,149 B1
(45) Date of Patent: Jul. 26, 2005

(54) SAFETY VEST

(76) Inventor: Ginger A. Ford, 1329 St. Rose Ave., Baton Rouge, LA (US) 70806

( * ) Notice: Subject to any disclaimer, the term of this patent is extended or adjusted under 35 U.S.C. 154(b) by 124 days.

(21) Appl. No.: 10/373,292

(22) Filed: Feb. 24, 2003

Related U.S. Application Data

(63) Continuation of application No. 09/544,192, filed on Apr. 6, 2000, now Pat. No. 6,525,662.

(51) Int. Cl.[7] ..... G08B 23/00

(52) U.S. Cl. ..... 340/573.1; 340/573.6; 340/539.1; 340/539.13; 441/80

(58) Field of Search ..... 340/573.1, 573.6, 340/984, 539.1, 539.13; 441/80, 88, 89, 91, 92, 93, 94, 96, 104, 106, 114–119, 121, 123

(56) References Cited

U.S. PATENT DOCUMENTS 5,029,293 A * 7/1991 Fontanille ..... 340/573.1
6,270,386 B1 * 8/2001 Visocekas ..... 441/80
6,525,662 B1 * 2/2003 Ford ..... 340/573.1

* cited by examiner

*Primary Examiner*—Daryl C Pope
(74) *Attorney, Agent, or Firm*—Jones, Walker, Waechter, Poitevent, Carrere & Denegre, L.L.P.

(57) ABSTRACT

A garment is provided for deterring a physical assault on a wearer and creating evidence of the assault, comprising a vest having visual indicia affixed thereto, such as the word "Evidence", displaying that the vest may be used as evidence in a criminal investigation. A dye release system containing a permanent and luminescent dye is affixed to the vest, which can be activated by the wearer prior to or during an assault. The dye is caused to be forcefully ejected from the dye release system, thereby contaminating the vest, the wearer, the assailant and the place where the assault took place. Preferably, the vest includes an electronic locating device, such as a sonic transmitter or GPS transmitter. Also, the vest preferably includes an audible alarm, a canine-detectable scent, and fingerprint susceptible surfaces thereon.

17 Claims, 2 Drawing Sheets

SAFETY VEST

This is a continuation of Ser. No. 09/544,192, filed on Apr. 6, 2000, which will issue on Feb. 25, 2003 and will be U.S. Pat. No. 6,525,662, to which this application claims priority and which is hereby incorporated by reference in its entirety.

BACKGROUND OF THE INVENTION

I. Field of the Invention

The present invention relates generally to garments worn by joggers, cyclists, backpackers and other persons for the purpose of deterring assaults and kidnappings by an attacker, and more particularly to vests which contain a visual display of its purpose and a permanent dye which can be released by the wearer.

II. Description of Prior Art

Outdoor exercise for women has become an increasingly risky venture in recent years. Joggers, cyclists, and backpackers have frequently been the target of criminal activity in the form of assaults, rape, kidnapping and murder. Common to most of these attacks is the absence of hard evidence as to the identity of the assailant, because the outdoor environment renders the recovery of hair samples and other forensic matter exceptionally difficult. Moreover, the attacks against women during outdoor exercise generally occurs while the woman is wearing very light clothing, making it difficult for the woman to carry protective equipment in the form of a gun, mace or other self-defense item. Consequently, the best ways for women to avoid becoming the victim of a violent attack are to: (a) deter the attacker from selecting the woman as a target at all, and (b) make the actual attack very difficult or undesirable for the attacker. As will be shown herein, the present invention satisfies both of these requirements in a manner that engenders confidence and security for the woman, and that does not interfere with the exercise activity.

Another troubling problem is that if an attack occurs, law enforcement officials may have a hard time locating the victim if she is either disabled or deceased. If the victim is still alive, time is of the essence in finding the person before further harm occurs. If the victim has been killed, recovery of the body as quickly as possible is essential to gathering time-sensitive evidence and pursuing the criminal. The ensuing description of the present invention will disclose how these situations can be resolved through a single well-designed garment.

Prior art safety garments for outdoor exercisers are numerous and widely variant as to their specific features. While the garment design can take many forms, such as a pair of shorts, a jacket, or even a belt or wrist band, the most common type of garment is a lightweight vest. For example, most vests used for this purpose are easily zipped or otherwise opened and closed in the front of the wearer or along the sides. They are usually light and "breathable" in that the fabric contains holes for passage of air to keep the wearer from becoming overheated. Additionally, these vests typically employ bright colors, reflective surfaces or illumination devices so that they can be readily seen by persons in vehicles or rescue workers.

What is noticeably lacking in these garments are features which specifically address the problems with the aforementioned attacks. While reflective surfaces and bright colors may serve as a deterrent to some small degree, these garments can be removed by the assailant during or after an assault, making the garments worthless from an evidentiary standpoint. Furthermore, there is nothing to link the victim to a specific attacker if an assault does occur. What is needed, therefore, is a garment for joggers and other persons which can: (I) provide a visual cue to would-be attackers that any attack will encounter difficulties, (2) allow the wearer to activate an audible alarm and/or release a permanent dye onto the attacker that will connect the attacker to the crime, (3) assist in locating the victim through the use of a canine detectable scent, global positioning system (GPS) transmitter and/or sonar transmitter, and (4) preserve evidence needed for a conviction of the assailant through the use of fingerprints and dye stains.

SUMMARY OF THE INVENTION

It is therefore an object of this invention to provide a safety garment which serves as a visual deterrent to a physical assault.

It is also an object of this invention to provide a safety garment which enables the wearer to spray a permanent dye from the garment to prevent or shorten a physical assault.

It is a further object of this invention to provide a safety garment which includes a locating transmitter for detection by a sonic or GPS receiver.

Yet another object of this invention is to provide a safety garment which includes an alphanumeric indicia for use with a registration system for tracking the wearer at all times.

These and other objects and advantages of the present invention will no doubt become apparent to those skilled in the art after having read the following description of the preferred embodiments which are contained in and illustrated by the various drawing figures.

Therefore, in a preferred embodiment, a garment for deterring a physical assault on a wearer and creating evidence of said assault, comprising a vest having a front portion and a rear portion, wherein said front and rear portions include a highly reflective surface; visual indicia affixed to said vest displaying that said vest may be used as evidence in a criminal investigation; a dye container affixed to said vest, wherein said dye container holds a releasable dye; and dye releasing means operatively connected to said dye container for causing a forceful ejection of said dye from said dye container upon actuation of said dye releasing means.

With respect to the vest itself, the front and rear portions of said vest are constructed primarily from a porous net material. The vest may include a removable hood, as well as a water-resistant and sealable pouch for carrying identification and other personal items. For use on cold days, the vest also optionally includes a removable, thermally insulated inner liner. Importantly, the vest preferably includes a visual indicia having the word "EVIDENCE" or similar symbol prominently displayed on said vest, either on the front portion, the rear portion or both.

In more preferred embodiments, the garment further comprises an audible alarm affixed to said vest, and wherein said alarm is selectively actuated by said wearer. The garment may further include electronic locating means affixed to said vest for allowing said vest to be located. Also, the garment may further include a canine-detectable scent affixed to said vest, as well at least one fingerprint-susceptible surface thereon.

The most preferred dye for use with the invention is a permanent, luminescent, fast-drying and water-resistant dye. In one embodiment, the dye container includes a first dye chamber affixed to said front portion of said vest and a second dye chamber affixed to said rear portion of said vest, and wherein said first and second dye chambers each include an exit port which directs released dye away from said wearer. In an alternate embodiment, the dye container includes a dye tube at least partially encircling the waist of said wearer, wherein said dye tube includes a plurality of exit ports which direct released dye away from said wearer. Further, the dye releasing means preferably includes a pull cord extending from said dye container. Alternative dye releasing means may include a remote activator via infrared or radio transmitter, a pressure sensitive switch or pad, a sound-activated switch, or the use of a pressurized container, such as a $CO_2$ cartridge.

In a preferred embodiment of the invention, the audible alarm is activated simultaneously by actuation of said dye releasing means. In one embodiment, the electronic locating means includes a sound transmitter activated by the actuation of said dye releasing means. In an alternate embodiment, the electronic locating means includes a global positioning system (GPS) transmitter. Also, for use of the vest within a registration system, the vest includes alphanumeric indicia corresponding to a specific wearer of said vest.

DETAILED DESCRIPTION OF THE PREFERRED EMBODIMENTS

Figure 1A:
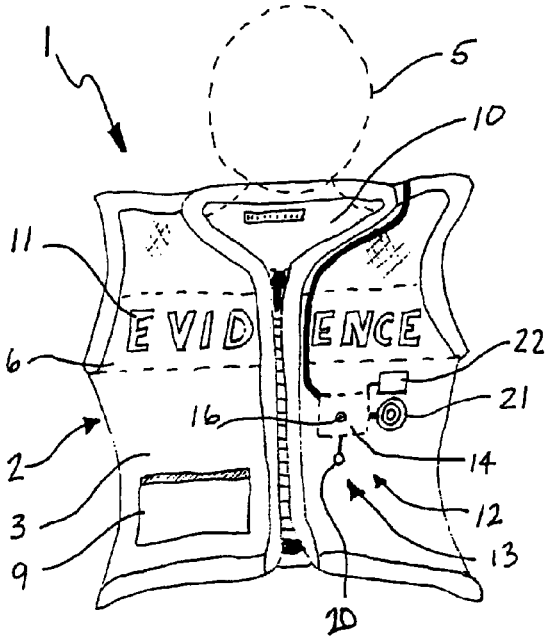
FIG. 1A is a front view of a preferred embodiment of the invention, depicting a vest having several features for the protection of the wearer, including a dye release system.
Figure 1B:
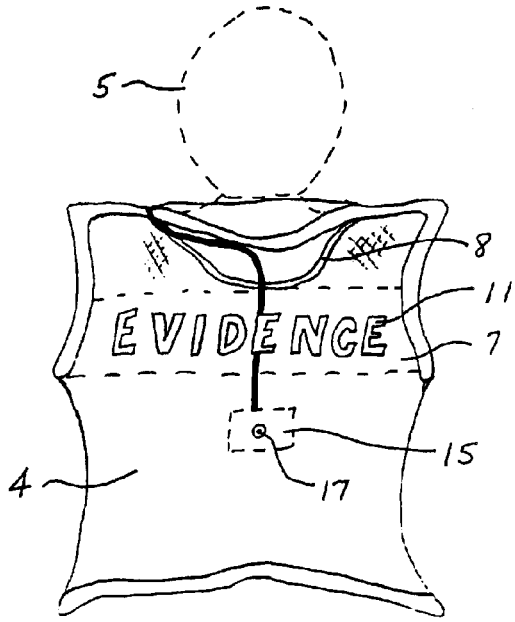
FIG. 1B is a rear view of the invention of FIG. 1A.

Turning now to FIGS. 1A and 1B, a garment 1 is provided for deterring a physical assault on a wearer 5 and creating evidence of such an assault. Generally, the garment 1 comprises a vest 2 having a front portion 3 and a rear portion 4. The front and rear portions 3,4 each include a highly reflective and/or luminescent surface 6,7, although such surfaces 6,7 may only partially cover the front and rear portions 3,4. The vest 2 is constructed primarily from a brightly colored, porous net material for the purpose of providing a cool, breathable fabric when used over light clothing. Although not strictly required by the invention, the vest 2 may also include a removable hood 8, as well as a water-resistant and sealable pouch 9 for carrying identification and other personal items. For use on cold days, the vest 2 also optionally includes a removable, thermally insulated inner liner 10.

One of the most distinguishing features of the present invention is the presence of a visual indicia 11 displaying that the vest 2 may be used as evidence in a criminal investigation. This feature, perhaps more than any other, catches the attention of all those who see the wearer 5 with the vest 2, including would-be assailants. In a preferred embodiment shown in FIGS. 1A and 1B, the visual indicia 11 comprises the word "EVIDENCE" prominently displayed on the vest 2, either on the front portion 3, the rear portion 4 or both. Ideally, the visual indicia 11 should be made from a material and color that is highly contrasted with the remaining material of the vest 2. One manner of accomplishing this objective is to provide the highly reflective surfaces 6,7 as the background material for the visual indicia 11, as shown in all of the figures. It would also be advantageous to use a material for these purposes that is highly susceptible to accepting human fingerprints so that recovery of this type of evidence is facilitated. The purpose of the visual indicia 11 is two-fold: (1) to remind any attacker of the criminal implications of any proposed assault, and (2) to provide an easily visible article of clothing for rescue persons in the event that the wearer 5 is either killed or incapacitated.

In the event that the mere visual impact of the vest 2 does not serve as a deterrent to an assailant, the vest 2 includes at least one dye containing means 12 affixed to the vest 2 which holds a releasable dye that can be sprayed away from the wearer 5 and onto an attacker and the surrounding environment. The dye containing means 12 is operatively connected to a dye releasing means 13 for causing a forceful ejection of the dye from the dye container 12 upon actuation of the dye releasing means 13.

The most preferred dye for use with the invention is a permanent, luminescent, fast-drying and water-resistant dye. Such a dye would be difficult to remove from the clothes and skin so that any suspect bearing evidence of the dye would be detained immediately. Moreover, resistance of the dye to dilution and smearing would preserve a crime scene for a longer period of time for law enforcement officials.

Figure 2A:
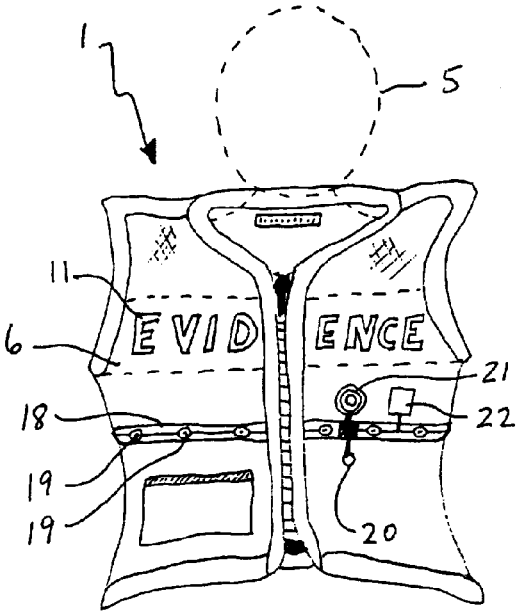
FIG. 2A is a front view of an alternate embodiment of the invention, depicting an alternative means for releasing the dye.
Figure 2B:
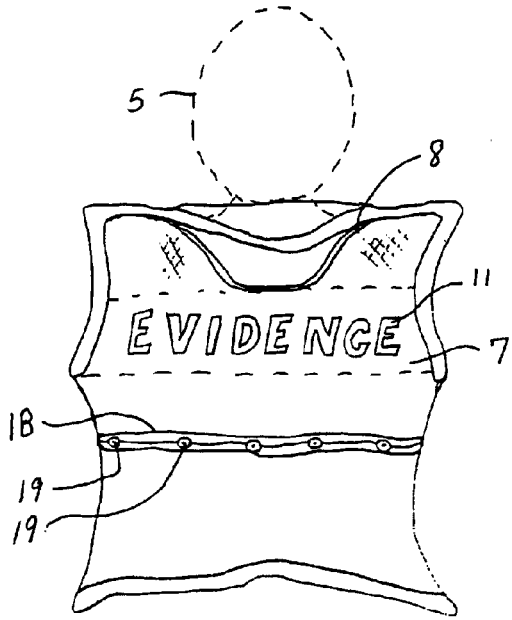
FIG. 2B is a rear view of the invention of FIG. 2A.

In one embodiment shown in FIGS. 1A and 1B, the dye containing means 12 includes a first dye chamber 14 affixed to the front portion 3 of the vest 2 and a second dye chamber 15 affixed to the rear portion 4 of the vest 2. Both first and second dye chambers 14,15 are connected to one another by a tube extending over the shoulder of the wearer 5 such that both first and second dye chambers 14,15 are activated simultaneously. Each of the first and second dye chambers 14,15 includes an exit port 16,17 which directs released dye away from the wearer 5. In an alternate embodiment shown in FIGS. 2A and 2B, the dye container 12 includes a dye tube 18 at least partially encircling the waist of the wearer 5, wherein the dye tube 18 includes a plurality of exit ports 19 which direct released dye away from the wearer 5 in all directions.

In both embodiments described above, the dye releasing means 13 preferably includes a pull cord 20 extending from the dye containing means 12. Although a variety of systems may be devised for forceful ejection of the dye, it is preferred that the dye containing means 12 employ a negative valve system where a predetermined amount of tension applied to the pull cord 20 causes air to be drawn into the dye container 12 to expel the dye itself. Alternatively, the pull cord 20 could be connected to a spring-loaded plunger system that effectively pumps the dye from the dye container 12 through the exit ports on demand. Alternative forms of the dye releasing means 13 may comprise a remote activator via infrared or radio transmitter, a pressure sensitive switch or pad, a sound-activated switch, or the use of a pressurized container, such as a $CO_2$ cartridge.

In more preferred embodiments, the vest 2 further comprises a battery-powered, audible alarm 21 affixed to the vest which can be selectively actuated by the wearer 5. In one version, the audible alarm 21 is activated simultaneously by actuation of the dye releasing means 13. However, if release of the dye would be premature, the alarm 21 may be separately activated by its own switch (not shown) protruding from the vest 2. Ideally, the alarm 21 should create a loud, piercing sound which will attract the attention of any nearby persons at the time of an attack.

In a further preferred embodiment, the vest 2 may further include electronic locating means 22 affixed to the vest 2 for allowing the vest 2 and/or the wearer 5 to be located. The electronic locating means 22 may include a sound transmitter activated by the actuation of the dye releasing means. In an alternate embodiment, the electronic locating means 22 may include a global positioning system (GPS) transmitter which is always on at the selection of the wearer 5.

Another optional feature of the present invention is a canine-detectable scent applied to the fabric of the vest 2 or a portion thereof. This type of scent would not be objectionable to the wearer 5 or other humans, but would be readily identifiable by law enforcement canines in the event of a search and rescue operation.

Finally, the present invention envisions that use of the vest 2 will be in the context of a registration system which identifies specific persons with specific vests. Therefore, it is preferred that the vest 2 include an alphanumeric indicia 23 corresponding to a specific wearer of the vest 2. In this manner, recovery of the vest 2 itself will allow officials to know the specific individual who is missing. This indicia 23 would be located in a prominent area on the vest 2, such as behind the neck on the rear portion 4 of the vest 2. While alphanumeric indicia 23 is perhaps the easiest to use, other types of identifying indicia may also be employed, such as bar codes or magnetic strips for the identical purpose.

All components of the vest 2, such as the dye containing means 12, the alarm 21, and the to electronic locating means 22, may optionally be sewn onto the exterior of the vest fabric. However, for protection of the components, they may be alternatively sewn into an inner fabric lining on the yoke of the vest 2.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. An article worn on the human body for deterring a physical assault and creating evidence of said assault comprising:

(a) a garment adapted to be worn on a human body, said garment having a front portion and a rear portion, wherein at least one of said front and said rear portions include a highly reflective surface;

(b) a visual indicia attached to said garment indicating that said garment may be used as evidence in a criminal investigation;

(c) a dye container affixed to said garment, where said dye container holds a releasable dye; and (d) a dye releasing means operatively connected to said dye container for causing a forceful ejection of said dye from said dye container upon actuation of said dye releasing means.

2. The article of claim 1 wherein said article further includes an audible alarm affixed thereto, whereby said audible alarm may be selectively actuated by a wearer.

3. The article of claim 1 wherein said article further includes an electronic locating means affixed to said garment for allowing said garment to be located.

4. The article of claim 1 wherein said garment further includes at least one finger-print susceptible surface area.

5. The article of claim 1 wherein said dye is a permanent dye.

6. The article of claim 1 wherein said dye is a luminescent dye.

7. The article of claim 1 wherein said dye container includes a first dye chamber affixed to said front portion of said garment and a second dye chamber affixed to said rear portion of said garment, and wherein said first and said second dye chambers each include an exit port which directs released dye away from a wearer.

8. The article of claim 1 wherein said dye releasing means included a pull cord operatively connected to said dye container.

9. The article of claim 2, wherein said audible alarm is activated by actuation of said dye release means.

10. The article of claim 3 wherein said electronic locating means includes a sound transmitter activated by actuation of said dye release means.

11. The article of claim 3 wherein said electronic locating means includes a global positioning system transmitter.

12. The article of claim 1 wherein said garment includes indicia corresponding to a specific wearer of said garment.

13. The article of claim 1 wherein said dye is a fast drying and water resistant dye.

14. The article of claim 1 wherein said garment further includes a removable thermally insulated liner.

15. An article worn on the human body for deterring a physical assault and creating evidence of said assault comprising:

(a) a garment adapted to be worn on a human body, said garment having a front portion and a rear portion, wherein at least one of said front and said rear portions include a highly reflective surface;

(b) a dye container affixed to said garment, wherein said dye container holds a releasable dye; and (c) a dye releasing means operatively connected to said dye container for causing a forceful ejection of said dye from said dye container upon actuation of said dye releasing means.

16. The article of claim 15 where said garment is a vest.

17. The article of claim 16 where said dye is a permanent dye.

* * * * *